US007647918B2

(12) United States Patent
Portner et al.

(10) Patent No.: US 7,647,918 B2
(45) Date of Patent: Jan. 19, 2010

(54) RADIAL PISTON PUMP FOR COMMON RAIL INJECTION SYSTEMS

(75) Inventors: Stefan Portner, Würzburg (DE); Ngoc-Tam Vu, Ludwigsburg (DE)

(73) Assignee: Siemens Aktiengesellschaft, Munich (DE)

( * ) Notice: Subject to any disclaimer, the term of this patent is extended or adjusted under 35 U.S.C. 154(b) by 21 days.

(21) Appl. No.: 10/595,451

(22) PCT Filed: Sep. 28, 2004

(86) PCT No.: PCT/EP2004/052338

§ 371 (c)(1),
(2), (4) Date: Feb. 19, 2007

(87) PCT Pub. No.: WO2005/040609

PCT Pub. Date: May 6, 2005

(65) Prior Publication Data

US 2007/0277785 A1 Dec. 6, 2007

(30) Foreign Application Priority Data

Oct. 23, 2003 (DE) ..... 103 49 310

(51) Int. Cl.
*F02M 41/06* (2006.01)
*F02M 41/00* (2006.01)

(52) U.S. Cl. ..... 123/450; 417/273

(58) Field of Classification Search ..... 123/450, 123/456, 497, 495, 446; 417/269, 273, 206, 417/441

See application file for complete search history.

(56) References Cited

U.S. PATENT DOCUMENTS

| | | | | |
|---|---|---|---|---|
| 2,679,808 | A | 6/1954 | Thun | |
| 5,944,493 | A | 8/1999 | Albertin et al. | 417/273 |
| 6,345,609 | B1 * | 2/2002 | Djordjevic | 123/509 |
| 6,446,604 | B1 * | 9/2002 | Guentert et al. | 123/456 |
| 6,872,056 | B2 | 3/2005 | Stiefel | 417/221 |
| 6,899,083 | B2 * | 5/2005 | Djordjevic | 123/446 |
| 7,118,350 | B2 * | 10/2006 | Graf et al. | 417/206 |
| 2001/0048091 | A1 | 12/2001 | Enomoto et al. | 251/129.15 |
| 2004/0045537 | A1 | 3/2004 | Simon et al. | 123/495 |

FOREIGN PATENT DOCUMENTS

| | | |
|---|---|---|
| DE | 19920998 | 11/2000 |
| DE | 101 18 884 A1 | 11/2002 |
| DE | 10139519 | 2/2003 |
| DE | 102 28 551 A1 | 1/2004 |
| WO | 02084105 | 10/2002 |

OTHER PUBLICATIONS

PCT International Search Report w/Written Opinion and English Translation, PCT/EP2004/052338, 16 pages, Mailing Date Feb. 4, 2005.

* cited by examiner

*Primary Examiner*—Mahmoud Gimie
(74) *Attorney, Agent, or Firm*—King & Spalding L.L.P.

(57) ABSTRACT

A high-pressure radial piston pump for common rail injection systems has a pump housing (1), a drive shaft (2), at least one pump piston (3) which can move in a radial direction in relation to the drive shaft (2) and a high pressure accumulator (4) integrated into the high-pressure radial piston pump. The high pressure accumulator (4) is embodied in the form of a ring.

20 Claims, 2 Drawing Sheets

RADIAL PISTON PUMP FOR COMMON RAIL INJECTION SYSTEMS

CROSS-REFERENCE TO RELATED APPLICATIONS

This application is a U.S. national stage application of International Application No. PCT/EP2004/052338 filed Sep. 28, 2004, which designates the United States of America, and claims priority to German application number DE 103 49 310.7 filed Oct. 23, 2003, the contents of which are hereby incorporated by reference in their entirety.

TECHNICAL FIELD

The invention relates to a high pressure radial piston pump for common rail injection systems with a high pressure accumulator integrated into the high pressure radial piston pump.

BACKGROUND

A high pressure radial piston pump for common rail injection systems with a high pressure accumulator integrated into the high pressure radial piston pump is already known from the applicant's older subsequently published patent application DE 10228551.9. The high pressure radial piston pump has a housing, in which there is a drive shaft. The drive shaft has an eccentric section on which a lifting ring is arranged. Preferably several pump pistons which can move in radial direction in relation to the drive shaft, and pump size lengthwise, are supported on the lifting ring. Each pump piston is assigned one intake valve and one pressure valve. Fuel is fed to the pump piston from the low-pressure section via the intake valve. After the pressure has been built up the compressed fuel is drained off via the pressure valve and delivered to the shared high pressure accumulator (common rail) via a high pressure pipe. In order to make a compact construction possible, the high pressure accumulator is integrated within the circumference of the high pressure radial piston pump.

The disadvantage of such a solution is that bringing the high pressure pipes to the high pressure accumulator within the pump housings is to an extent very complicated.

SUMMARY

Therefore, the task of the invention is to provide a high pressure radial piston pump for common rail injection systems with a high pressure accumulator integrated into the high pressure radial piston pump, and to do so simply and cost-effectively.

A high pressure radial piston pump for common rail injection systems comprises a pump housing, a drive shaft, at least one pump piston, which can move in a radial direction in relation to the drive shaft and a high pressure accumulator integrated into the high pressure radial piston pump, wherein the high pressure accumulator is embodied in the form of a ring. The high pressure accumulator can be arranged concentric in relation to the drive shaft. The high pressure accumulator can be formed by a ring groove realized in the pump housing at the front side and sealed with a cover. At least one metallic sealing surface can be formed on the pump housing and/or on the cover in order to seal the high pressure accumulator. The cover can be connected to the pump housing at least by means of one central screw arranged concentric in relation to the ring groove. The high pressure accumulator can be embodied as a ring groove which is realized in the outer circumference of a rotationally symmetrical pump insert. The outer circumference of the pump insert may operate together with a corresponding inner circumference surface of the pump housing. The pump insert can be embodied in cylindrical form. A high pressure radial piston pump may further comprise at least one high pressure connection embodied on the high pressure accumulator in order to supply at least one injector of an internal combustion engine. The high pressure accumulator can be effectively connected with a pressure control valve integrated into the high pressure radial piston pump or arranged on the high pressure radial piston pump.

The invention is characterized in that the high pressure accumulator is embodied in the form of a ring. The embodiment of the high pressure accumulator in the form of a ring makes an especially cost-effective and simple production possible. In addition, the embodiment of the high pressure accumulator in the form of a ring has the advantage that the high pressure pipes can enter the high pressure accumulator at any point desired. This results in the high pressure pipes being very short and simple to construct.

In a preferred embodiment of the invention, the high pressure accumulator is arranged concentric in relation to the drive shaft. This results in a symmetrical and particularly compact arrangement of the high pressure fuel pipes within the pump.

A further preferred embodiment of the invention makes provision for the high pressure accumulator to be formed by a ring groove realized in the pump housing on the front side and sealed with a cover. In this way it is particularly easy to realize the ring groove in the pump housing by rotation for instance. The ring groove can be realized in this way in one processing step at the same time as the housing bore which is necessary for the drive shaft, without the pump housing having to be rechucked during the production process. This results in a particularly cost-effective production. The cover can likewise be produced as a cost-effective rotary component.

A further advantageous embodiment of the invention provides for at least one metallic sealing surface to be formed in order to seal the high pressure accumulator on the pump housing and/or on the cover. This means that an additional sealing element can be dispensed with. The metallic sealing surface thus reduces the number of components required and, in addition, facilitates the pump assembly. It is not possible to insert the seal wrongly. The metallic sealing surface can be preferably formed by raised areas in the pump housing and/or in the cover.

A further advantageous embodiment of the invention provides for the cover to be connected to the pump housing by means of a central screw arranged concentric in relation to the ring groove. Thereby the central screw offers the advantage that the force is spread evenly across the entire circumference of the ring groove thereby securely sealing the high pressure accumulator. In a preferred embodiment a through hole is realized in the central screw, and leakage flow from the high pressure radial piston pump can be led off through said through hole.

A further advantageous embodiment of the invention provides for the high pressure accumulator to be embodied as a ring groove, with the ring groove being placed in the outer circumference of a rotationally symmetrical pump insert. In this way, the ring groove can be very easily and cost-effectively realized in the outer circumference of the rotationally symmetrical pump insert, by means of rotation for instance. The pump insert is pushed into a corresponding opening in the pump housing and the outer circumference surface of the rotationally symmetrical pump insert operates here together with the inner circumference surface of the pump housing.

In a particularly advantageous embodiment of the invention, the pump insert is embodied in cylindrical form. The cylindrical embodiment enables the production of the pump insert and the corresponding pump opening to be particularly simple and good value.

A further advantageous embodiment of the invention provides that at least one high pressure connection is formed on the high pressure accumulator in order supply at least one injector of an internal combustion engine. In this way, the high pressure connection can be formed in the pump housing or in the pump cover.

A further advantageous embodiment of the invention provides that the high pressure accumulator has an effective connection with a pressure control valve integrated in the high pressure radial piston pump or arranged on the high pressure radial piston pump. Integrating the pressure control valve or arranging it close to the high pressure radial piston pump allows a particularly compact design to be achieved.

BRIEF DESCRIPTION OF THE DRAWINGS

Exemplary embodiments of the invention are explained below with reference to the schematic drawings, in which.

Elements having the same construction and function have the same reference number in all the figures.

DETAILED DESCRIPTION

Figure 1:
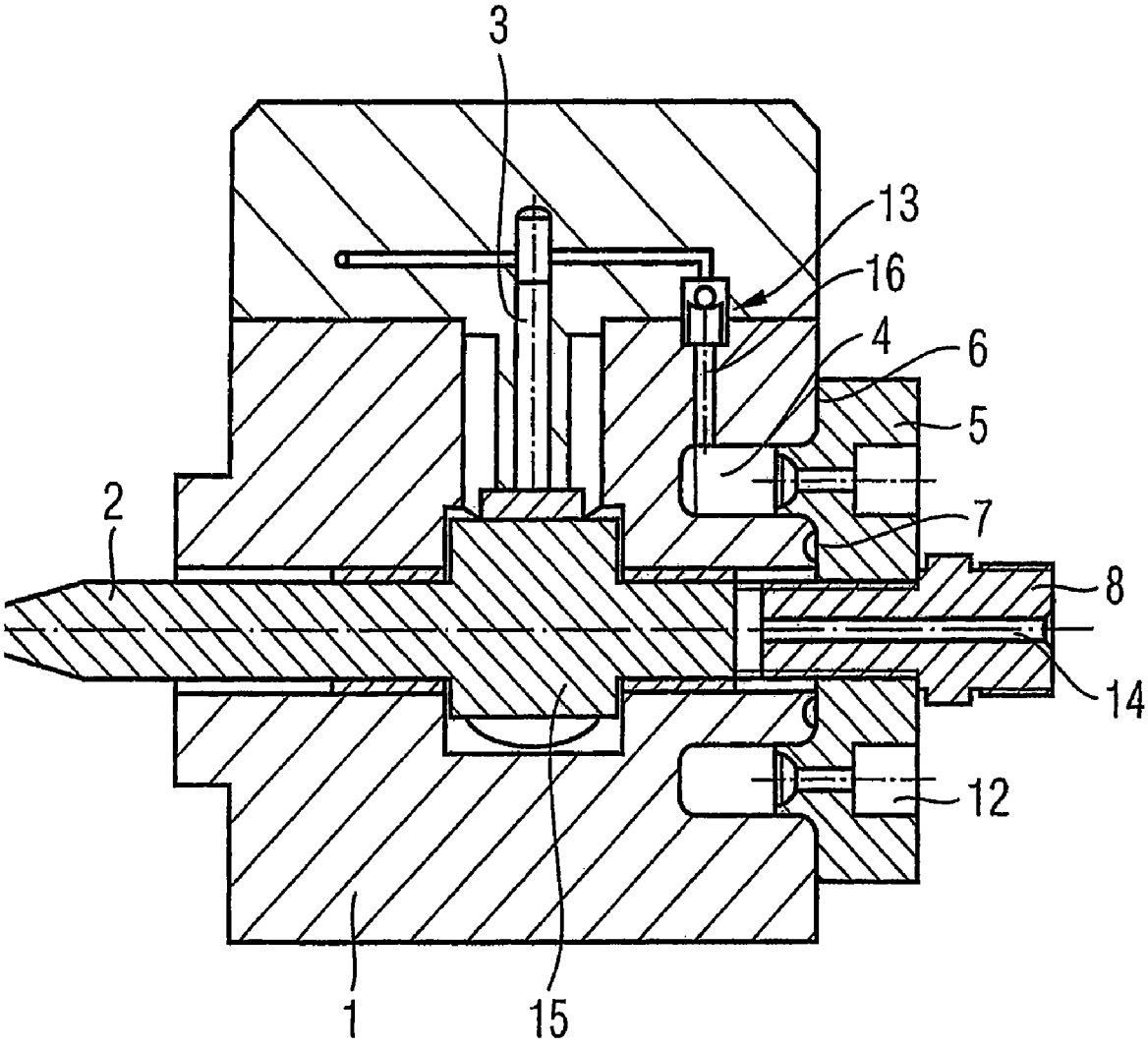
FIG. 1 shows a first embodiment of the high pressure radial piston pump, in which the high pressure accumulator is formed by a ring groove realized in the pump housing on the front side and sealed with a cover.

FIG. 1 shows a first embodiment of the high pressure radial piston pump. The high pressure radial piston pump has a pump housing 1, in which a drive shaft 2 can be pivoted. The drive shaft 2 is embodied as an eccentric shaft. On the outer circumference of the eccentric tappet 15 are arranged preferably three pump pistons at an angle of 120° to each other. In the course of one revolution of the drive shaft 2, each pump piston 3 runs through a complete intake and compression stroke. In the course of the intake stroke, the cylinder piston 3 moves in the direction of drive shaft 2 and fuel is fed to the cylinder chamber via an intake valve which is not illustrated in FIG. 1. After the cylinder piston 3 has reached its lower final position, the direction of movement is reversed and the compression stroke begins. There the intake valve closes and the fuel is subsequently compressed to a pressure of up to 1800 bar in the course of the upward movement of the pump piston 3. Once pump piston 3 has reached the upper final position, the pressure valve 13 opens and the compressed fuel flows out of the cylinder chamber via a high pressure pipe 16 to the shared high pressure accumulator 4. Thereby the high pressure accumulator 4 is embodied in the form of a ring in a front side of the pump housing 1. The ring groove can be realized easily by machining processes, by rotation for instance. Thereby the obvious thing would be to make the ring groove in a single operation together with making the bearing holes for drive shaft 2. This allows the pump housing 1 to be machined in one operation without being rechucked, which results in a particularly simple production process. The open side of the high pressure accumulator 4 is sealed by a cover 5. Thereby the cover 5 is screwed to the pump housing 1 by a central screw 8. The central screw 8 offers the advantage that thanks to the central arrangement, the force is spread evenly across the entire circumference of the ring groove. In addition, a through bore 14 is formed in the central screw 8 and a leakage flow from the pump housing 1 is led off via said through bore. To seal the high pressure accumulator 4 especially securely, additional screws can be used, which are spaced out on the circumference of cover 5. There are several high pressure connections 12 embodied in cover 5. The high pressure accumulator 4 can be connected with the individual injectors of the internal combustion engine via the high pressure connections 12. Metallic sealing surface 6, 7 ensures the cover is securely sealed. The metallic sealing surfaces 6, 7 have a raised area. This causes the creation of a very high surface pressure, which ensures the sealing is secure. The raised area can be formed in this way in the cover 5 and/or in the pump housing 1.

The high pressure accumulator 4 embodied in the form of a ring and integrated into the pump housing 1 enables a particular compact design to be achieved. As opposed to prior art where the individual high pressure pipes are first brought together in the pump housing and are then run as a shared pipe out of the pump housing to the high pressure accumulator, in the embodiment according to the invention, each high pressure pipe 16 enters into the high pressure accumulator separately. This removes the otherwise usual intersection of bores when the individual high pressure pipes meet. Until now, the intersection of bores has been very problematic especially with regard to the stability of the components.

By virtue of the fact that the high pressure pipes enter into the high pressure accumulator individually and at any point, the high pressure pipe 16 can be formed as short as possible. The short high pressure pipes 16 can be manufactured here with a greater tolerance as differences do not make themselves so strongly felt on the short lengths. As opposed to that, in prior art very small tolerances must be adhered to as otherwise it could happen that the individual high pressure pipes do not meet up exactly.

In order to realize as short high pressure pipes 16 as possible, the pipes preferably join into the high pressure accumulator at an angle of 120° to each other.

Figure 2:
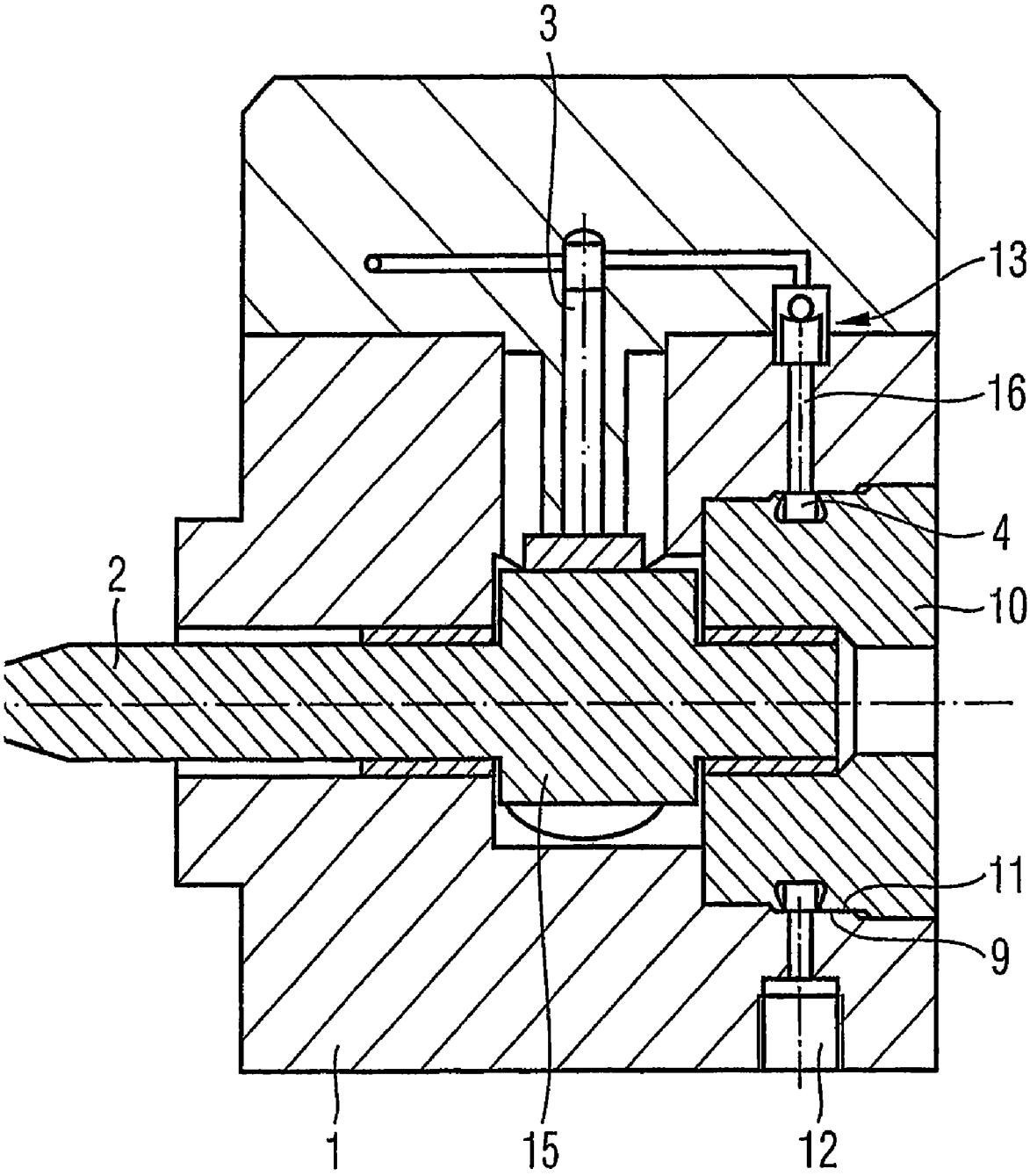
FIG. 2 shows a second embodiment of the high pressure radial piston pump in which the high pressure accumulator is formed as a ring groove, which is realized in the outer circumference of a rotationally symmetrical pump insert.

FIG. 2 shows a second exemplary embodiment of the high pressure radial piston pump. The main method of operation of the high pressure radial piston pump is identical to the first exemplary embodiment, which will be referred to here. The difference lies only in the embodiment of the high pressure accumulator 4. As opposed to the first exemplary embodiment, the high pressure accumulator 4 is not embodied in the pump housing 1 but in a pump insert 10. The high pressure accumulator 4 is embodied here as a ring groove in the shell of a rotationally symmetrical pump insert 10. Thereby the ring groove can again be easily made, in particular using a machining process, by means of rotation for instance. Preferably a cylindrical pump insert is chosen as the rotationally symmetrical pump insert, as said pump insert must be produced easily and with the smallest tolerances. However, other rotationally symmetrical inserts are also conceivable, for example a conically formed pump insert. The pump insert 10 is pushed into a correspondingly formed opening of the pump housing 1 and, not shown in FIG. 2, is fixed using additional fasteners. The outer circumference surface 9 of the pump insert 10 corresponds here with the inner circumference surface 11 of the pump housings 1. thereby ensuring a free of play seat of pump insert 10. The free of play seat already provides good sealing between the pump housing 1 and the pump insert 10. Over and above that, in the pump insert 10 and/or in the pump housing 1, additional sealing lips are provided in the area of the high pressure accumulator 4.

Instead of a cylindrical pump insert 10, it is also possible to form the pump insert in a conical shape. A corresponding conical surface is then formed in pump housing 1. The conical embodiment of pump insert 10 and pump housing 1 offers the advantage that when the two components are screwed down, the contact surfaces wedge together with each other and that as a result the sealing between pump housing 1 and pump insert 10 is already good in the area of the high pressure accumulator 4.

By embodying the high pressure accumulator 4 in the form of a ring, the high pressure pipes 16 can again be made very short whereby they can again enter into the high pressure accumulator 4 at any position desired. They preferably enter into the high pressure accumulator 4 at an angle of 120° to each other.

A particularly compact design of the injection system is achieved when a pressure control valve, which is necessary for control, is integrated directly into the high pressure accumulator 4 or is fixed straight onto the pump housing 1.

In pump housing 1, there are embodied high pressure connections 12, by means of which the high pressure accumulator 4 can be connected to the injectors of an internal combustion engine. The high pressure connections 12 can, alternatively, also be made in the pump insert 10.

Thus the invention distinguishes itself in that by embodying the high pressure accumulator 4 in the form of a ring, production can be particularly favorable in cost and effort. Because the high pressure pipes 16 can enter into the high pressure accumulator 4 at any location desired, one can realize especially short high pressure pipes 16. All in all, the high pressure radial piston pump according to the invention makes a particularly compact design of radial piston pump and high pressure accumulator possible.

What is claimed is:

1. A high pressure radial piston pump for common rail injection systems comprising:

a pump housing, a drive shaft, at least one pump piston, which can move in a radial direction in relation to the drive shaft and a high pressure accumulator integrated into the high pressure radial piston pump, wherein the high pressure accumulator is embodied in the form of a complete ring.

2. A high pressure radial piston pump according to claim 1, wherein the high pressure accumulator is arranged concentric in relation to the drive shaft.

3. A high pressure radial piston pump according to claim 1, wherein the high pressure accumulator is formed by a ring groove realized in the pump housing at the front side and sealed with a cover.

4. A high pressure radial piston pump according to claim 3, wherein at least one metallic sealing surface is formed on the pump housing and/or on the cover in order to seal the high pressure accumulator.

5. A high pressure radial piston pump according to claim 3, wherein the cover is connected to the pump housing at least by means of one central screw arranged concentric in relation to the ring groove.

6. A high pressure radial piston pump according to claim 1, wherein the high pressure accumulator is embodied as a ring groove which is realized in the outer circumference of a rotationally symmetrical pump insert.

7. A high pressure radial piston pump according to claim 6, wherein the outer circumference of the pump insert operates together with a corresponding inner circumference surface of the pump housing.

8. A high pressure radial piston pump according to claim 6, wherein the pump insert is embodied in cylindrical form.

9. A high pressure radial piston pump according to claim 1, comprising at least one high pressure connection embodied on the high pressure accumulator in order to supply at least one injector of an internal combustion engine.

10. A high pressure radial piston pump according to claim 1, wherein the high pressure accumulator is effectively connected with a pressure control valve integrated into the high pressure radial piston pump or arranged on the high pressure radial piston pump.

11. A high pressure radial piston pump for common rail injection systems comprising:

a pump housing, a drive shaft, at least one pump piston, which can move in a radial direction in relation to the drive shaft and a complete-ring shaped high pressure accumulator integrated into the high pressure radial piston pump.

12. A high pressure radial piston pump according to claim 11, wherein the ring shaped high pressure accumulator is arranged concentric in relation to the drive shaft.

13. A high pressure radial piston pump according to claim 11, wherein the ring shaped high pressure accumulator is formed by a ring groove realized in the pump housing at the front side and sealed with a cover.

14. A high pressure radial piston pump according to claim 13, wherein at least one metallic sealing surface is formed on the pump housing and/or on the cover in order to seal the ring shaped high pressure accumulator.

15. A high pressure radial piston pump according to claim 13, wherein the cover is connected to the pump housing at least by means of one central screw arranged concentric in relation to the ring groove.

16. A high pressure radial piston pump according to claim 11, wherein the ring shaped high pressure accumulator is embodied as a ring groove which is realized in the outer circumference of a rotationally symmetrical pump insert.

17. A high pressure radial piston pump according to claim 16, wherein the outer circumference of the pump insert operates together with a corresponding inner circumference surface of the pump housing.

18. A high pressure radial piston pump according to claim 16, wherein the pump insert is embodied in cylindrical form.

19. A high pressure radial piston pump according to claim 11, comprising at least one high pressure connection embodied on the ring shaped high pressure accumulator in order to supply at least one injector of an internal combustion engine.

20. A high pressure radial piston pump according to claim 11, wherein the ring shaped high pressure accumulator is effectively connected with a pressure control valve integrated into the high pressure radial piston pump or arranged on the high pressure radial piston pump.

* * * * *